US009302506B2

(12) United States Patent
Uptergrove et al.

(10) Patent No.: US 9,302,506 B2
(45) **Date of Patent: *Apr. 5, 2016**

(54) APPARATUS AND METHOD FOR PRINTING ON ARTICLES HAVING A NON-PLANAR SURFACE

(71) Applicant: Plastipak Packaging, Inc., Plymouth, MI (US)

(72) Inventors: Ronald L. Uptergrove, Northville, MI (US); Manish K. Senta, Plymouth, MI (US)

(73) Assignee: Plastipak Packaging, Inc., Plymouth, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/914,025

(22) Filed: Jun. 10, 2013

(65) Prior Publication Data

US 2013/0265353 A1 Oct. 10, 2013

Related U.S. Application Data

(63) Continuation of application No. 12/490,564, filed on Jun. 24, 2009, now Pat. No. 8,459,760.

(60) Provisional application No. 61/075,050, filed on Jun. 24, 2008.

(51) Int. Cl.

| | |
|---|---|
| ***B41J 11/00*** | (2006.01) |
| ***B41M 5/00*** | (2006.01) |
| ***B41J 3/407*** | (2006.01) |

(52) U.S. Cl.

CPC ..... *B41J 11/008* (2013.01); *B41J 3/4073* (2013.01); *B41M 5/0082* (2013.01); *B41M 5/0088* (2013.01)

(58) Field of Classification Search

None

See application file for complete search history.

(56) References Cited

U.S. PATENT DOCUMENTS

| | | | |
|---|---|---|---|
| 1,832,501 | A | 11/1931 | Pittenger et al. |
| 3,417,175 | A | 12/1968 | Brown et at |
| 3,490,363 | A | 1/1970 | Derrickson |
| 3,999,190 | A | 12/1976 | Brown et al. |
| 4,074,279 | A | 2/1978 | Ikeda et al. |
| 4,519,310 | A | 5/1985 | Shimizu et al. |

(Continued)

FOREIGN PATENT DOCUMENTS

| | | |
|---|---|---|
| CA | 1277176 C | 12/1990 |
| DE | 102004032058 | 12/2009 |

(Continued)

OTHER PUBLICATIONS

Steven H. Johnson; "Ink-Jet Printing System—An Analytical Computer Model"; IEEE Transactions on Industry Applications, vol. 1A-12, No. 3, May/Jun. 1976, pp. 294-305.

(Continued)

*Primary Examiner* — Justin Seo

(74) *Attorney, Agent, or Firm* — Dykema Gossett PLLC

(57) ABSTRACT

A method for printing on an article having a non-planar surface in an embodiment includes obtaining coordinates or a geometry for a non-planar surface of an article; determining a tangent orientation for a print head in three dimensions; and using the tangent orientation and positioning the print head relative to the non-planar surface of the article. Embodiments of apparatus for printing on articles having non-planar surfaces are also disclosed.

13 Claims, 4 Drawing Sheets

(56) References Cited

U.S. PATENT DOCUMENTS

| | | | |
|---|---|---|---|
| 4,914,451 | A | 4/1990 | Morris et al. |
| 5,011,862 | A | 4/1991 | Melber et al. |
| 5,182,571 | A | 1/1993 | Creagh et al. |
| 5,411,140 | A | 5/1995 | Byer |
| 5,528,280 | A | 6/1996 | Endo et al. |
| 5,587,405 | A | 12/1996 | Tanaka et al. |
| 5,624,743 | A | 4/1997 | Malhotra |
| 5,705,257 | A | 1/1998 | Froh et al. |
| 5,753,325 | A | 5/1998 | McDaniel et al. |
| 5,815,282 | A | 9/1998 | Kano |
| 5,858,514 | A | 1/1999 | Bowers |
| 5,984,456 | A | 11/1999 | Bern |
| 6,002,844 | A | 12/1999 | Kishida et al. |
| 6,082,563 | A | 7/2000 | Kohn et al. |
| 6,135,654 | A | 10/2000 | Jennel |
| 6,147,041 | A | 11/2000 | Takahashi et al. |
| 6,235,358 | B1 | 5/2001 | Goto et al. |
| 6,314,875 | B1 | 11/2001 | Steenbergen |
| 6,406,115 | B2 | 6/2002 | Mantell et al. |
| 6,409,294 | B1 | 6/2002 | Zimmermann et al. |
| 6,435,655 | B1 | 8/2002 | Yoshihira |
| 6,460,991 | B1 | 10/2002 | Temple et al. |
| 6,493,677 | B1 | 12/2002 | von Rosen et al. |
| 6,513,435 | B2 | 2/2003 | Detzner |
| 6,527,133 | B1 | 3/2003 | McCollum et al. |
| 6,550,905 | B1 | 4/2003 | Deckers |
| 6,578,476 | B2 | 6/2003 | Liguori |
| 6,655,798 | B2 | 12/2003 | Temple |
| 6,663,929 | B1 | 12/2003 | Tabota et al. |
| 6,682,191 | B2 | 1/2004 | Temple et al. |
| 6,699,352 | B2 | 3/2004 | Sawatsky |
| 6,705,218 | B2 | 3/2004 | Rapp |
| 6,706,342 | B2 | 3/2004 | Kong et al. |
| 6,749,913 | B2 | 6/2004 | Watanabe et al. |
| 6,769,357 | B1 | 8/2004 | Finan |
| 6,837,376 | B2 | 1/2005 | Pauli |
| 6,845,365 | B2 | 1/2005 | von Rosen et al. |
| 7,128,406 | B2 | 10/2006 | Dixon et al. |
| 7,133,058 | B2 | 11/2006 | Lee |
| 7,162,325 | B2 | 1/2007 | Silverbrook |
| 7,182,418 | B2 | 2/2007 | Harvey et al. |
| 7,579,388 | B2 | 8/2009 | Kiefer |
| 7,597,933 | B2 | 10/2009 | Muraoka |
| 7,891,490 | B2 | 2/2011 | Raming |
| 2002/0097280 | A1 | 7/2002 | Loper et al. |
| 2003/0000909 | A1 | 1/2003 | Sakaguchi et al. |
| 2003/0021961 | A1 | 1/2003 | Ylitalo |
| 2004/0126507 | A1 | 7/2004 | O'Brien |
| 2004/0200558 | A1 | 10/2004 | Stevens et al. |
| 2005/0211371 | A1 | 9/2005 | Hirst et al. |
| 2006/0115639 | A1 | 6/2006 | deVries et al. |
| 2006/0142415 | A1 | 6/2006 | Ylitalo et al. |
| 2006/0144261 | A1 | 7/2006 | Uptergrove |
| 2006/0250464 | A1 | 11/2006 | Sheinman |
| 2007/0157559 | A1 | 7/2007 | Till |
| 2007/0229497 | A1 | 10/2007 | Zinniel et al. |
| 2008/0011177 | A1 | 1/2008 | Muraoka |
| 2008/0186354 | A1* | 8/2008 | White ..... 347/38 |
| 2008/0202370 | A1 | 8/2008 | Muraoka |
| 2008/0252671 | A1* | 10/2008 | Cannell et al. ..... 347/9 |
| 2009/0160901 | A1 | 6/2009 | Achhammer |
| 2009/0276088 | A1 | 11/2009 | Ruddy |
| 2011/0154626 | A1 | 6/2011 | VanDenBogart |

FOREIGN PATENT DOCUMENTS

| | | | |
|---|---|---|---|
| EP | 0088630 | | 9/1983 |
| EP | 0385624 | | 9/1990 |
| EP | 0657849 | | 6/1995 |
| EP | 1435296 | | 7/2004 |
| EP | 1586459 | | 10/2005 |
| EP | 1671804 | | 6/2006 |
| JP | 5330402 | | 3/1978 |
| JP | 55-176136 | | 12/1980 |
| JP | 62221472 | | 9/1987 |
| JP | 08072885 | | 3/1996 |
| JP | 2000281031 | | 10/2000 |
| JP | 2004244077 | | 9/2004 |
| JP | 2005119097 | | 5/2005 |
| JP | 2005119243 | | 5/2005 |
| JP | 2005283968 | | 10/2005 |
| JP | 2005313457 | | 11/2005 |
| WO | 9908935 | | 2/1999 |
| WO | 9920468 | | 4/1999 |
| WO | 03002349 | A2 | 1/2003 |
| WO | 2004009360 | | 1/2004 |
| WO | 2004016438 | A1 | 2/2004 |
| WO | 2004043702 | | 5/2004 |
| WO | 2006073536 | A2 | 7/2006 |
| WO | 2008009284 | A1 | 1/2008 |
| WO | 2008064248 | | 5/2008 |
| WO | 2009157613 | | 12/2009 |

OTHER PUBLICATIONS

Jianying Shang, et al.; "Comparison of Different Methods to Measure Contact Angles of Soil Colloids"; Journal of Colloid and Interface Science, 328 (2008), pp. 299-307.

Agfa-Gevaert; "Universal Print Head" Brochure, 2005.

* cited by examiner

APPARATUS AND METHOD FOR PRINTING ON ARTICLES HAVING A NON-PLANAR SURFACE

RELATED APPLICATION

This application is a continuation of U.S. patent application Ser. No. 12/490,564, filed Jun. 24, 2009, which claims the benefit of U.S. Provisional Application 61/075,050, filed Jun. 24, 2008, both of which are incorporated by reference in their entirety as if fully set forth herein.

TECHNICAL FIELD

The present invention relates to an apparatus and method for printing images on articles having a non-planar surface.

BACKGROUND

Trial and error methods for printing on substrates are commonly inconsistent, tedious, and time-consuming, especially at the production level. Printing with an acceptable level of quality on objects that include one or more non-planar (e.g., curved) portions, such as a shoulder portion of a plastic container, can prove to be challenging.

For some applications, it is desirable for the print head to move to a more optimal print position and/or orientation relative to the surface to be printed.

SUMMARY

The present invention discloses, inter alia, an apparatus for printing on an article having a non-planar surface. An embodiment of the apparatus includes a means for determining a tangent for a non-planar surface of an article, and a means for positioning a print head relative to the article using information associated with the tangent. Methods for printing on articles having non-planar surfaces are additionally disclosed.

BRIEF DESCRIPTION OF THE DRAWINGS

Embodiments of the invention will now be described, by way of example, with reference to the accompanying drawings, wherein.

DETAILED DESCRIPTION

Figure 1:
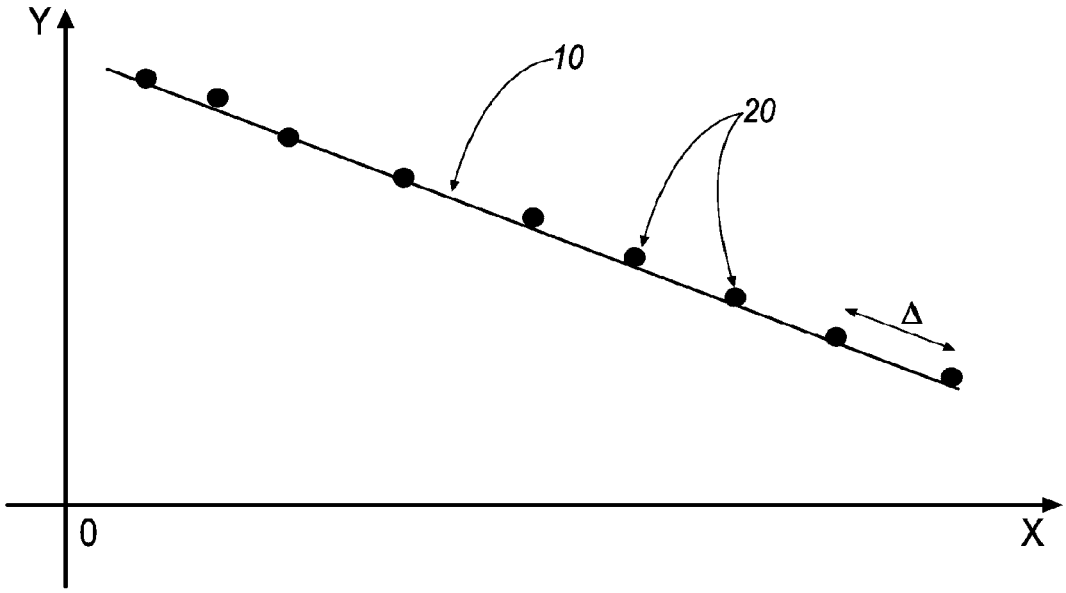
FIG. 1 is a graphical representation of a plot of points selected with respect to a printing surface or substrate.

Reference will now be made in detail to embodiments of the present invention, examples of which are described herein and illustrated in the accompanying drawings. While the invention will be described in conjunction with embodiments, it will be understood that they are not intended to limit the invention to these embodiments. On the contrary, the invention is intended to cover alternatives, modifications and equivalents, which may be included within the spirit and scope of the invention as defined by the appended claims.

Among other things, the present invention utilizes a mathematically-based formula or calculation (e.g., correlation) to provide a specified/optimized print head angle. The specified/optimized print head angle may involve three principal axes that are associated with a sabre angle, a cross process angle, and a process angle. The information associated with the calculation/correlation can provide, inter alia, print head positioning information, including information concerning the angle the print head should be rotated or positioned to improve or better "optimize" print quality. Such improved relative print head positioning/orientation can, without limitation, provide greater print image consistency with respect to non-planar surfaces.

An embodiment of the invention involves a study of a deviation of curvature with respect to a relevant non-planar print surface. The method includes a calculation of a tangent/slope for a range of points on the curved surface that are within an intended print region or area. To assist with the alignment of an associated print head, up to three principle angles may be determined/defined. The angles include a sabre angle, a process direction angle, and a cross process direction angle. Based upon a specified or desired print density (dpi), a sabre angle can be determined. Using the sabre angle as a reference, the other angles, i.e., the process direction and/or cross process direction angles, can be determined. An example of such a procedure is further described herein.

An embodiment of the procedure includes picking a range of points (e.g., 1 to 250, or even more) based on a specified or determined print width associated with the surface of a printing surface (or printing substrate). Three-dimensional coordinates (X, Y, and Z) associated with the surface to be printed may be identified or found with respect to a common reference entity—for example, using 3-D drafting/modeling software.

Based on the desired print resolution, sabre angle, and print dimensions, an embodiment of a system provided in connection with the invention can select or pick a minimum/specified number of points along or about the sabre line. This information can be used to help find a more realistic tangent for points on the surface. It is noted that generally an increased number of points will provide a better numerical converging during an iteration process.

Measuring the offset distances between successive points (e.g., using a least-squares analysis or other "best fit" line-fitting calculations) can help assess the line placement "accuracy" (or optimized placement) on the surface (or substrate, as the case may be as to printing surface) with respect to the sabre line.

The coordinates that are determined to best represent or embody the curvature of the substrate or surface to be printed on are selected before the print angle(s) are calculated. For example, if the x-coordinates describe a curvature of cross process, then those points can be used to calculate the cross process angle. The direction process angle may be similarly determined.

Next, the distance between the coordinates may be calculated using the following equation:

$$D = \text{Square Root of } [(x_2-x_1)^2+(y_2-y_1)^2+(z_2-z_1)^2] \text{ (the "distances equation")}$$

Using the trigonometric functions between the distances calculated and the offset between each coordinate point can provide the required angle for that point. The foregoing process can be repeated for other points in the point selection range. If desired, the points can be plotted in graphical form. The points and/or plotting thereof, can describe the nature of point deviation and/or provide the tangent/slope of these points at the reference sable angle. Using an imaginary line technique, the average angle for all the slope points can be found. The same process can be used to determine the other angle.

FIG. 1 illustrates the procedural points in a schematic format. FIG. 1 generally illustrates an X axis and a Y axis. Line 10 represents a sabre line drawn at the sabre angle provided by the printing resolution (i.e., dpi). Points 20 represent points picked at the print surface/substrate—the points define the x, y, z coordinates. Delta Δ is the offset distance that is maintained at each point. Based on the geometry, the system can maintain constant delta Δ or keep variable offset distance.

Figure 2:
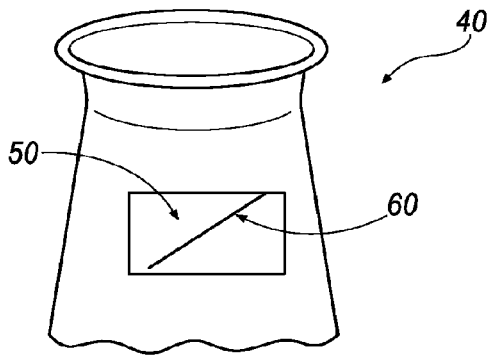
FIG. 2 is an example of an article having a non-planar surface and an associated printing region or area—with indicated sabre line.

The following is provided by way of a non-limiting example. FIG. 2 illustrates a portion of an article 40 (e.g., a beaker) with a non-planar surface (e.g., upper portion of the beaker) having an identified print area or print region 50. The geometry of the article 40 provides an example of a printing surface/substrate. A sabre line 60 is shown relative to the print region 50. Based on the desired printing resolution, the inclined line is the head sabre. Next, a desired number of points are picked up, typically based on the predefined range, close to the sabre line and within the printing region.

Figure 3:
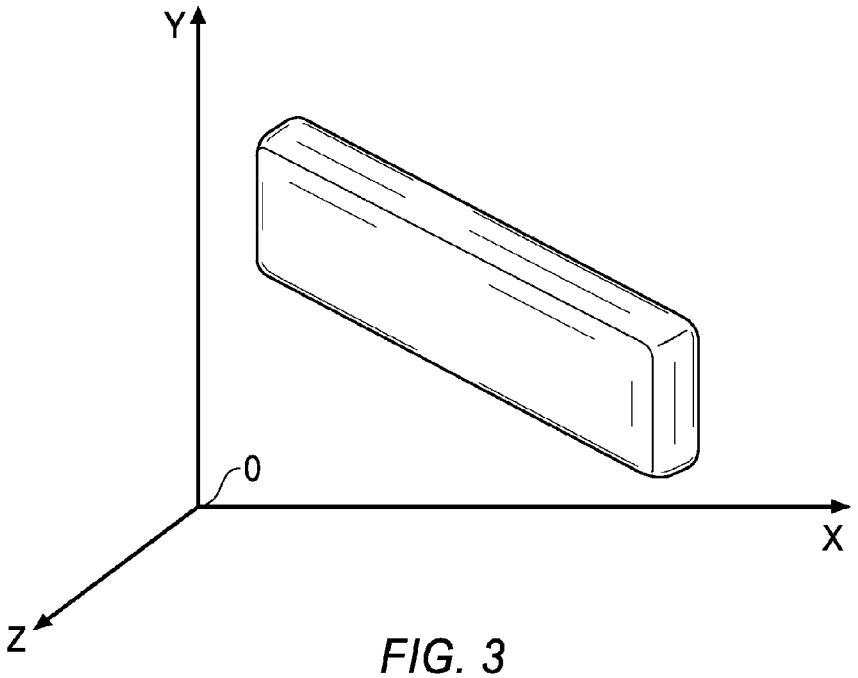
FIG. 3 is an illustration of a print head orientation in three-dimensional space.

FIG. 3 illustrates a generic print head orientation in three-dimensional space. With reference to the figure, plane XZ represents the plane of the sabre angle, which is determined by the print resolution. Angle XOZ is the sabre angle. Plane XY represents the plane of the cross process on the head with respect to the printing surface/substrate in 3D space. Angle XOY is the cross process angle. Plane YZ represents the plane of the process on the head with respect to the printing surface/substrate in 3D space. Angle YOZ is the process angle. It is noted that the figure and foregoing description are intended to provide an exemplary relationship. The aforementioned planes are subject to change and modification with respect to different printing techniques and/or setups.

An embodiment of a procedure involving aspects of the invention (such as those noted above) may comprise several steps. In a non-limiting embodiment:

(a) a range of points (e.g., 1 to 250, or more) is selected based on the desired/required print width on an identified printing surface/substrate;

(b) the X, Y, and Z coordinates—with respect to a common reference point/entity—may be found, for example, using drafting/modeling software;

(c) based on the required/desired printing resolution, sabre angle, and print dimensions, a minimum number of points (e.g., 10 to 30) are picked along the sabre line (the points may be used to help find more realistic tangents for every point on the surface);

(d) offset distances are measured between each successive point to better understand its placement accuracy on the printing surface/substrate with respect to the sabre line;

(e) the coordinate that best describes the curvature of the printing surface/substrate is selected before calculating the associated printing angles—for example, if the X coordinates describe the curvature of cross process, then those points can be used for determining the cross process angle;

(f) a similar determination (as noted in (e)) may be used to determine the process direction angle;

(g) the distances between coordinates are then formulated using the "distances equation";

(h) using trigonometric functions between the distances calculated and the offset between each coordinate point provides the required/desired angle for that point;

(i) the foregoing steps may be repeated for all (or at least most) of the points identified in the point selection range;

(j) the points may, optionally, be plotted (e.g., on a graph sheet)—the plotting of the points describes the nature of point deviation or the tangent/slope at such points at the reference sabre angle;

(k) line-fitting techniques are used to find the average angle for the slope points; and (l) the process may be repeated with respect to the other non-sabre angle.

Figure 4:
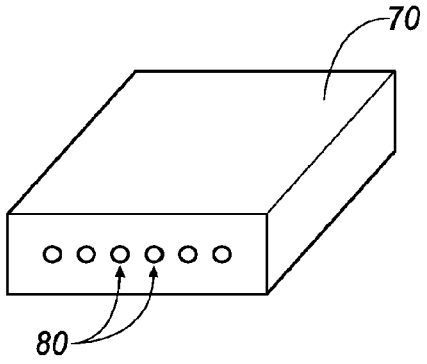
FIG. 4 is an illustration of an example of a print head.
Figure 5:
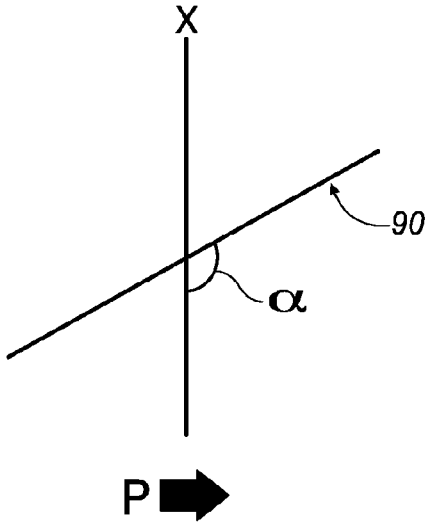
FIG. 5 is a representation of a sabre angle relative to an X-axis.

FIG. 4 depicts a generic print head 70 including a plurality of nozzles. The print head 70 may, without limitation, comprise a print head of the type used for digital ink printing. The head may include as many as 320 or more nozzles. The nozzles, which may be conventional in nature, commonly eject ink in a straight line. FIG. 5 generally illustrates a first angle (α), or sabre angle, with reference to an X-axis and a sabre line 90. With further reference to the figure, the process direction is identified by the letter "P" and the accompanying arrow. As generally illustrated, the sabre angle reduces the print height (viewed vertically in the X direction), but will at the same time increase the associated dots per inch (dpi).

Figure 6:
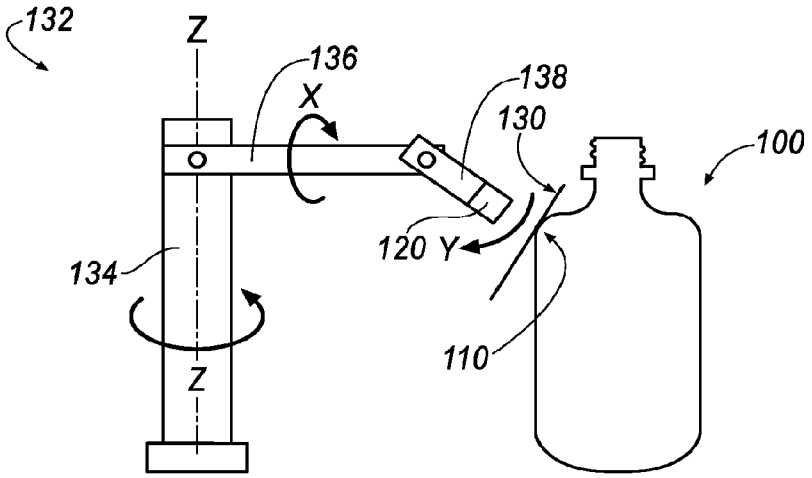
FIG. 6 is a schematic representation of a print head orientation relative to a non-planar surface of an article.

A sample container shoulder application is illustrated in FIG. 6. In the illustrated embodiment, a container 100 is shown including a non-planar shoulder portion 110. The container 100 may, without limitation, comprise a plastic container. A print head 120 is schematically shown positioned to print toward a tangent line 130 associated with the shoulder portion 110 of the illustrated container 100. An embodiment of a means for positioning the print head 120 is generally illustrated in FIG. 6 in the form of a mechanical apparatus 132. The mechanical apparatus may, for example, comprise a plurality of movable portions or segments. Without limitation, the mechanical apparatus or arm may include a first portion or segment 134, a second portion or segment 136, and a third portion or segment 138. As generally shown in the illustrated embodiment, the first portion or segment 134 may be configured to rotate about a Z-axis; the second portion or segment 136 may be configured to rotate about an X-axis; and the third portion or segment 138 may be configured to rotate or swing about a Y-axis. The portions or segments 134, 136, and 138 may be operationally positioned independently or in coordination by a controller. The controller controls the moving/positioning of a print head 120 (which may be connected or operationally attached to a portion of the mechanical apparatus 132—e.g., to portion or segment 138) for printing at a specified position and/or orientation (e.g., on a tangent relative to a print surface). Such a configuration can, among other things, permit better optimization of a print head based on the geometry associated with non-planar surfaces associated with the container.

Figure 7:
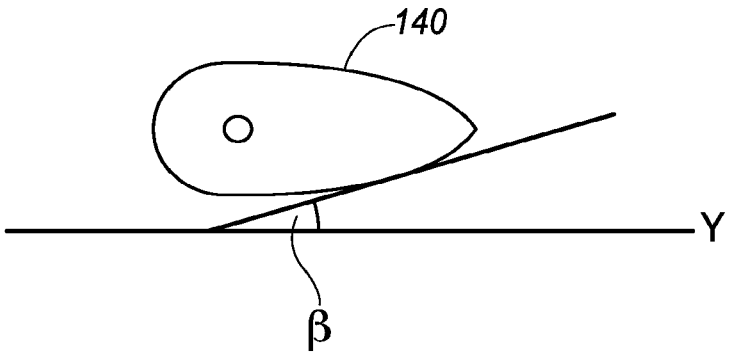
FIG. 7 is a representation of a second angle relative to a Y-axis that generally illustrates how a print head may be turned relative to a top-view of an article.
Figure 8:
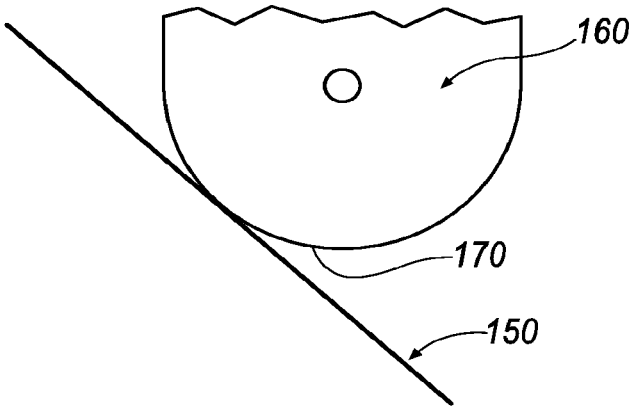
FIG. 8 is a schematic representation of a tangent line with respect to a non-planar portion of an article.

FIG. 7 depicts a top-view of an article 140 (which may be a container) and an angle (β) associated with a Y-axis. The illustrated embodiment generally shows how a print head may be rotated or turned to minimize distortion. FIG. 8 shows a simplified cross sectional representation of a tangent line 150 with respect to an article 160 (e.g., bottle) having a non-planar (curved) portion 170.

Among the other aspects and features discussed, the present invention provides a system that can obtain a geometry of a surface, calculate an optimized orientation of the print head in three dimensions (via X-Y-Z coordinates), and use that information to better position the print head to optimize printing relative to a given non-planar surface(s) of an article.

The foregoing descriptions of specific embodiments of the present invention have been presented for purposes of illustration and description. They are not intended to be exhaustive or to limit the invention to the precise forms disclosed, and various modifications and variations are possible in light of the above teaching. The embodiments were chosen and described in order to explain the principles of the invention and its practical application, to thereby enable others skilled in the art to utilize the invention and various embodiments with various modifications as are suited to the particular use contemplated. It is intended that the scope of the invention be defined by the claims and their equivalents.

What is claimed:

1. A method for printing on an article having a non-planar surface, the method comprising:

obtaining coordinates or a geometry for a non-planar surface of an article;

determining a tangent orientation for a print head using a sabre angle based upon a specified or desired print density (dpi) and calculations of a tangent/slope for a range of points on the non-planar surface that are within an intended print region or area;

measuring or determining offset distances between successive points along or about the sabre line;

using the tangent orientation and positioning the print head relative to the non-planar surface of the article; and printing on the intended print region or area of said article.

2. The method of claim 1, wherein said article is a plastic container.

3. The method of claim 2, wherein the plastic container is a plastic bottle.

4. The method of claim 1, wherein the positioning of the print head relative to the non-planar surface of said article involves a sabre angle, a process direction angle, and a cross process direction angle.

5. The method of claim 4, wherein the process direction and the cross process direction angles are determined from or using the sabre angle.

6. The method of claim 1, wherein a minimum or specified number of points are selected or picked along or about the sabre line.

7. The method of claim 6, wherein the minimum or specified number of points are used to determine additional tangent points on the surface.

8. The method of claim 6, an iterative process is employed to increase the number of points selected or picked along or about the sabre line to provided improved numerical convergence.

9. The method of claim 1, wherein the range of points on the non-planar surface that are within an intended print region or area are, at least in part, based on a specified or determined print width associated with a printing surface or substrate.

10. The method of claim 1, wherein the geometry of the non-planar surface is identified from or provided by three-dimensional drafting or modeling software.

11. The method of claim 1, wherein the determination of offset distances involves using a least-squares analysis or a line-fitting calculation.

12. The method of claim 1, including assessing a line placement on the non-planar surface with respect to the sabre line; calculating a distance between coordinates; and applying trigonometric functions between distances calculated between coordinates and the offset distances between each coordinate point to provide a print angle for that point.

13. The method of claim 12, including providing print angles for a plurality of points.

* * * * *